US010301748B2

(12) United States Patent
Morgner

(10) Patent No.: US 10,301,748 B2
(45) Date of Patent: May 28, 2019

(54) FIBER PROCESSING SYSTEM ALONG WITH A METHOD FOR OPENING AND MIXING FIBER MATERIAL IN A FIBER PROCESSING SYSTEM

(71) Applicant: TEMAFA MASCHINENFABRIK GMBH, Bergisch Gladbach (DE)

(72) Inventor: Joerg Morgner, Kuerten (DE)

(73) Assignee: TEMAFA MASCHINENFABRIK GMBH, Bergisch Gladbach (DE)

( * ) Notice: Subject to any disclaimer, the term of this patent is extended or adjusted under 35 U.S.C. 154(b) by 148 days.

(21) Appl. No.: 15/388,452

(22) Filed: Dec. 22, 2016

(65) Prior Publication Data

US 2017/0183797 A1 Jun. 29, 2017

(30) Foreign Application Priority Data

Dec. 23, 2015 (DE) ..... 10 2015 122 807

(51) Int. Cl.

| | |
|---|---|
| ***D01G 7/06*** | (2006.01) |
| ***D01G 9/12*** | (2006.01) |
| ***D01G 9/18*** | (2006.01) |
| ***D01G 21/00*** | (2006.01) |
| ***D01G 23/00*** | (2006.01) |

(52) U.S. Cl.

CPC ..... *D01G 7/06* (2013.01); *D01G 9/12* (2013.01); *D01G 9/18* (2013.01); *D01G 21/00* (2013.01); *D01G 23/00* (2013.01)

(58) Field of Classification Search

CPC .. D01G 7/00; D01G 7/02; D01G 7/06; D01G 7/08; D01G 7/10; D01G 7/12

USPC ..... 19/80 R

See application file for complete search history.

(56) References Cited

U.S. PATENT DOCUMENTS

| | | | | |
|---|---|---|---|---|
| 2,090,955 A | | 8/1937 | Taylor | |
| 2,718,671 A | | 9/1955 | Smith | |
| 3,208,107 A | * | 9/1965 | Kotter | D01G 13/00 19/145.5 |
| 4,300,267 A | * | 11/1981 | Winch | D01G 9/00 19/107 |
| 4,317,260 A | | 3/1982 | Blackburn | |

(Continued)

FOREIGN PATENT DOCUMENTS

| | | |
|---|---|---|
| DE | 28 55 311 A1 | 7/1979 |
| EP | 2 028 297 A2 | 2/2009 |

OTHER PUBLICATIONS

EP Seareh Report, dated May 29, 2017.

*Primary Examiner* — Shaun R Hurley
*Assistant Examiner* — Bao-Thieu L Nguyen
(74) *Attorney, Agent, or Firm* — Dority & Manning, P.A.

(57) ABSTRACT

A fiber processing system for opening and mixing fiber material includes a plurality of bale openers for opening fiber bales. Conveying devices are arranged downstream of the bale openers for mixing and conveying the opened fiber material to a downstream processing device. The bale openers are divided into at least two opener groups, wherein each opener group produces a respective fiber mixture. Each opener group is allocated one or more of the conveying devices arranged in such a manner that the respective fiber mixtures are transported directly away from their associated opener group in different directions and the fiber mixtures are subsequently combined before or in the processing device into an overall fiber mixture.

13 Claims, 2 Drawing Sheets

(56) References Cited

U.S. PATENT DOCUMENTS

| | | | | | |
|---|---|---|---|---|---|
| 4,514,881 | A * | 5/1985 | Hergeth | D01G 7/10 | 19/80 R |
| 4,531,262 | A * | 7/1985 | Reiche | D01G 13/00 | 19/105 |
| 4,766,648 | A * | 8/1988 | Kerley | D01B 1/04 | 19/80 R |
| 4,888,857 | A * | 12/1989 | Pinto | D01G 7/10 | 19/80 R |
| 4,979,272 | A * | 12/1990 | Demuth | D01G 7/08 | 19/80 R |
| 5,025,533 | A * | 6/1991 | Faas | D01G 13/00 | 19/105 |
| 5,210,909 | A * | 5/1993 | Toedtli | D01G 13/00 | 19/145.5 |
| 5,933,921 | A * | 8/1999 | Jossi | D01G 31/003 | 19/200 |
| 6,442,803 | B1 * | 9/2002 | Foster | D01G 13/00 | 19/145.5 |
| 6,773,545 | B2 * | 8/2004 | Tanner | D21B 1/066 | 162/20 |
| 6,786,438 | B2 * | 9/2004 | Winn | D01G 9/04 | 19/48 R |
| 2009/0077770 | A1 | 3/2009 | Morgner et al. | | |

* cited by examiner

FIBER PROCESSING SYSTEM ALONG WITH A METHOD FOR OPENING AND MIXING FIBER MATERIAL IN A FIBER PROCESSING SYSTEM

FIELD OF THE INVENTION

The invention relates to a fiber processing system for opening and mixing fiber material, for example cotton and the like, with a multiple number of bale openers for opening fiber bales and conveying devices downstream of the bale openers for mixing and conveying the opened fiber material to a downstream processing device, for example a mixing chamber or a carding feed. The invention also relates to a method for opening and mixing fiber material in a fiber processing system.

BACKGROUND

Bale openers are used to roughly detach fibers of natural or synthetic origin from fiber bales. There are different types of bale openers, including, among others, those for which the bales are placed close to each other and one arm of the machine slowly travels over, while it detaches and sucks away individual fiber lumps. Since multiple bales are placed side by side, a mixture of the fiber lumps of various bales already takes place here. This improves the mixture. With other known bale openers, each bale opener weighs its fiber material and delivers it to the associated conveying device. Such bale openers are designed, for example, as weighing tray feeders, with which only a specific predetermined quantity of fibers is delivered. Processed materials are, for example, chemical fibers made of PP (polypropylene), PA (polyamide), PES (polyester), etc.

The removal of the opened and weighed fiber material takes place either by means of a conveyor belt, onto which the fiber material plucked off from the bale row falls or is deposited. Alternatively, the detached fiber material is transported away by means of a suction conveyor. The opened and possibly mixed fiber material is generally collected or fed to a subsequent processing machine, such as a carding engine, a carding machine or the like, which is equipped with a tray feeder or a filling shaft as a feeding device.

Frequently, multiple bale openers are placed next to each other, in order to increase the throughput and to make the mixture more effective by means of joint conveyance on the conveyor belt. However, the total number of bale openers is given an upper limit of, as a rule, up to six machines, since—without retrofittings of the participating devices—the fiber volume from the available conveying devices (that is, the conveyor belt(s)) can no longer be handled. Also, the scales placed on the transport path are not capable of weighing very large quantities of fiber.

SUMMARY OF THE INVENTION

A task of this invention is to increase the fiber material throughput of a fiber processing system without significant retrofittings on existing machines having to be carried out. Additional objects and advantages of the invention will be set forth in part in the following description, or may be obvious from the description, or may be learned through practice of the invention.

The tasks are achieved by a fiber processing system as described and claimed herein, with which the multiple number of bale openers is divided into at least two opener groups, each of which produces a fiber mixture. Each opener group is thereby allocated with a conveying device, whereas the conveying devices are able to transport away the fiber mixtures in different directions in relation to the associated opener group. In their further process, the conveying devices are guided in the direction of the specified processing device, before or in which the fiber mixtures are combined into an overall fiber mixture.

The tasks are also achieved by a corresponding method, as set forth herein.

The invention offers in particular the advantage that at least two conveying devices are designed and arranged in such a manner that they are able to transport away the associated fiber mixture from one opener group—relative to the respective opener group—in different directions. The conveying devices are preferably guided back together immediately before (or even in) the processing device, such that the overall fiber mixture can be processed in the processing device, preferably a mixing chamber or a carding feed. In this manner, conveying devices (in particular, known conveying devices) and known scales can be used. These are then preferably used for one of the fiber material sub-streams or fiber mixtures.

In the present context, the term "fiber mixture" is understood as a fiber accumulation that contains fibers obtained from multiple bale openers and are mixed with each other, which are mixed and transported on a conveyor belt (or multiple conveyor belts running alongside each other).

Opener groups in accordance with the invention do not have to appear as a spatially arranged group of bale openers. Although this is probably the case in most applications, the term "opener group" generally refers to the corresponding functional unit that dispenses fiber material onto a conveying device that transports the fibers of such bale openers in a common direction. The term "conveying device" also refers to a device with regard to its function of mixing and transporting away fibers that are obtained from an opener group.

According to a preferred embodiment of the invention, the bale openers of at least two opener groups are arranged in one row. In the case of a total of two opener groups with a total of, for example, ten bale openers, such ten bale openers are arranged side by side, whereas each opener group comprises, for example, five bale openers. The division may be, for example, six to four bale openers, or seven to three bale openers. With such two opener groups, the one conveying device conveys the fiber mixture of the one opener group in one direction and the other conveying device of the other opener group in a different direction.

Alternatively or additionally, the bale openers of at least two opener groups are arranged opposite each other (directly opposite or offset from each other), whereas the specified conveying devices convey the fiber mixtures relative to the respective opener group in opposite directions and, viewed in absolute terms, in a common direction. In the case of two opposing opener groups (in each case, viewed from the rear side of a bale opener in the direction of its outlet), the fiber mixture of the one opener group is transported away to the right and the fiber mixture of the oppositely arranged opener group is transported away to the left. Both directions then run parallel and are oriented in the same manner (have the same alignment). In particular, with this embodiment, it is appropriate if the two conveying devices are formed as one common conveying device, in particular a conveyor belt, on which the two fiber mixtures are, viewed in the direction of transport, conveyed essentially side by side. The two fiber mixtures can also be pushed against each other mechanically in order to reduce their overall conveying width.

According to a preferred embodiment of the invention, at least one of the conveying devices comprises one or more conveyor belts. In this case, a conveyor belt is able to transport away the fibers from one or more or all of the bale openers of an opener group. A single conveyor belt can, for example, be responsible for an opener group, or a multiple number of conveyor belts connected one behind the other can be responsible for it, in particular to enable directional changes of the conveying direction. At this, a multiple number of conveyor belts can be subsequently arranged at an angle to each other.

According to one embodiment, a multiple number of conveyor belts run close to each other, in order to convey the fiber material from the bale openers of an opener group. The fiber material obtained from an opener group is mixed on the conveyor belt(s). When the conveying device changes direction, a further, angled row of conveyor belts running close to each other then follows.

Alternatively or additionally, at least one of the conveying devices is formed as a conveying tube, in which a fiber mixture is pneumatically conveyed.

Particularly preferably, the processing device is connected upstream of a separate collecting device, to which the conveying devices lead and in which the fiber mixtures (M1, M2) are combined. Accordingly, the collecting device is connected upstream of the processing device, and ensures that the overall fiber mixture is fed to the processing machine.

The collecting device is advantageously formed as a fiber accumulator or as a fiber air separator, in which the fibers are at least partially separated from the air surrounding them. With this, the air is sucked away, for example through a screen, through which the fibers cannot pass.

Preferably, the processing device is connected upstream of a feeding device, in particular a tray feeder or a filling shaft, which is connected upstream of the collecting device. Accordingly, the conveying sequence of the fibers is as follows: fiber bales—bale opener—conveying devices that run in different directions—collecting device—possible feeding device—processing machine.

With an additional embodiment, the fiber mixtures are first combined in the processing machine.

It is also possible for each fiber mixture to pass through a fiber air separator before the fiber mixtures are combined, for example in a funnel or an additional fiber air separator, in order to then be transferred to the processing machine.

The invention also relates to a method for opening and mixing fiber material in a fiber processing system, in particular a fiber processing system as described above, whereas the fiber material is obtained by opening fiber bales with the assistance of a multiple number of bale openers. The multiple bale openers are divided into at least two opener groups, whereas each opener group produces a fiber mixture. The at least two fiber mixtures are deposited on a respective conveying device, and each conveying device transports the respective fiber mixture in a different direction in relation to the respective opener group. These fiber mixtures are recombined before or in a downstream processing device.

This method has the advantage, among other things, that the conveying and weighing processes can be, in principle, carried out as before; that is, in particular without modifications with regard to a larger design of the known machines. For example, it is not necessary to construct extra-wide conveyor belts or scales with an over-sized supporting surface. Rather, the transport of the detached fiber material is divided into at least two transport paths, which are different in relation to the respective opener group, and which are each made available by a conveying device.

As stated above, in the case of opposing opener groups, the two conveying devices can also be combined into one single conveying device.

Preferably, the at least two fiber mixtures guided on different transport paths (with at least partially different conveying directions) are mechanically and/or pneumatically combined in a collecting device, preferably in the form of a fiber air separator or a fiber mixer. It is possible, for example, for one of the at least two fiber mixtures to be fed mechanically into the collecting device, while the other fiber mixture is pneumatically sucked in. In the case of more than two fiber mixtures fed to the collecting device, preferably, the multiple fiber mixtures are fed by means of the pneumatic sucking into the collecting device.

The combined fiber mixtures form an overall fiber mixture, which is preferably initially fed to a tray feeder or a filling shaft that, in turn, feeds the processing machine, for example a mixing chamber or a carding feed.

BRIEF DESCRIPTION OF THE DRAWINGS

In the following, the invention is described on the basis of figures. The following is shown.

DETAILED DESCRIPTION

Figure 1:
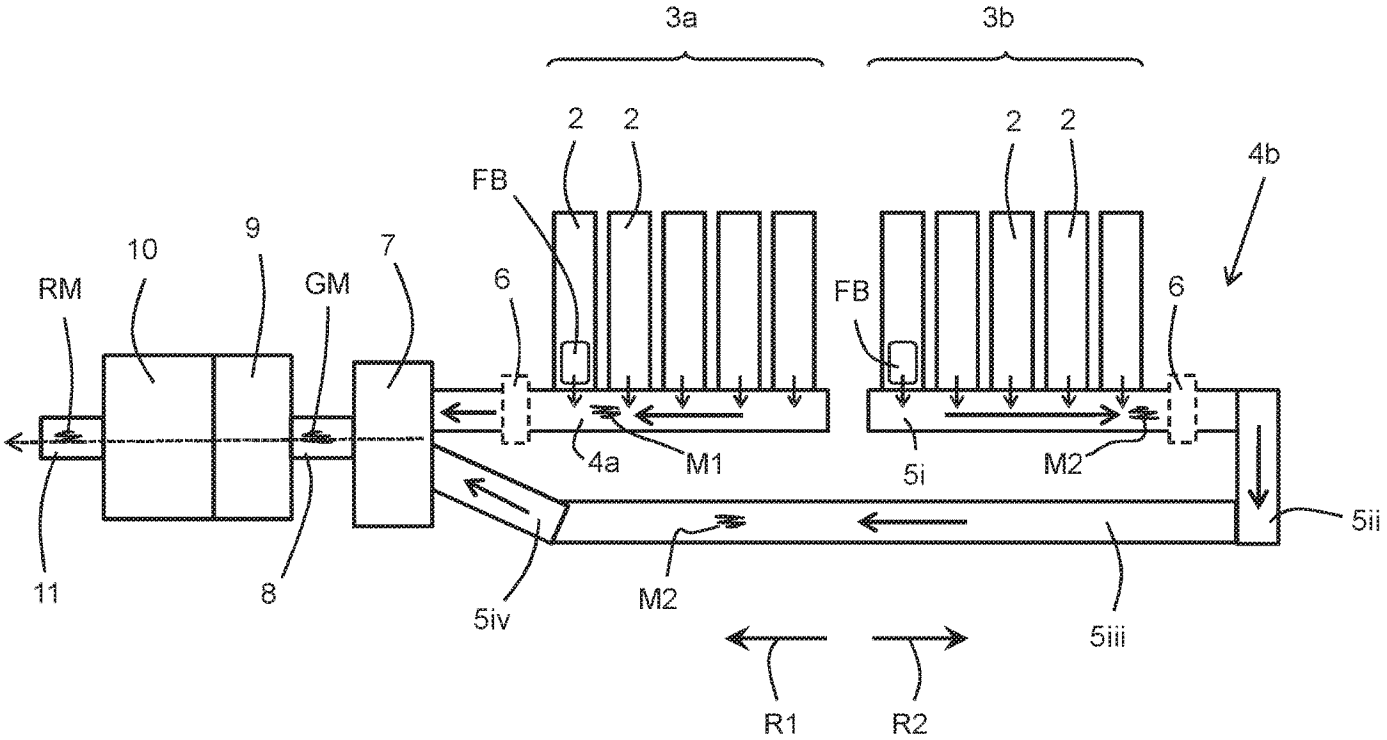
FIG. 1 a top view of a first embodiment of a schematically shown fiber processing system, and FIG. 2 a top view of a second embodiment of a schematically shown fiber processing system.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 schematically shows a fiber processing system 1 with ten bale openers 2 arranged in a row in a top view, which are formed, for example, as weighing tray feeders. The bale openers 2 are divided into two opener groups 3*a*, 3*b*, each of which in the present case comprises five bale openers 2 arranged directly next to each other. In some of the bale openers 2, a fiber bale FB is indicated, from which a removal device (not shown) tears off fibers. Multiple fiber bales FB can also be placed side by side in a bale opener 2 in front of its removal device (not shown). Each of these opener groups 3*a* or 3*b* is allocated with a conveying device 4*a* or 4*b*, onto which the bale openers 2 dispense the fibers that are detached or opened. In accordance with the invention, the conveying directions of the conveying sections of the two conveying devices 4*a* and 4*b* opposite to the bale openers 2 run in different directions R1 and R2, which are opposite here.

The arrows that are not provided with reference signs on the conveying devices 4*a*, 4*b* indicate the direction of travel of the conveying devices 4*a*, 4*b*.

The conveying devices 4*a*, 4*b* comprise conveyor belts, which also serve as so-called "mixing belts" for mixing the fiber material, deposited on them, of a respective opener group 3*a* or 3*b* from, in the present case, the respective five bale openers 2. By this, the mixture does not arise through an active mixing, but through the placement of the fiber material of the bale openers 2 of a respective opener group 3*a* or 3*b*, on top of and/or next to each other A conveying device 4*a* or 4*b* can be formed as a single conveyor belt or as an arrangement of individual conveyor belts or as a multiple number of conveyor belts running close to each other.

The conveying device 4*a* guides the fiber mixture M1, which is transported by it and arises through the depositing of the bale openers 2 of the opener group 3*a*, directly in the direction R1 of a fiber processing device 10, while the conveying device 4*b* transports away the fiber mixture M2 in the opposite direction R2. The fiber mixtures M1, M2 are only indicated on a short section of their respective transport path.

The conveying device 4*b* is divided into a multiple number of conveying sections 5*i*, 5*ii*, 5*iii*, 5*iv*, which as a whole form an approximate U-shaped profile. The conveying section 5*i* guides the fiber mixture along the opener group 3*b* (in the opposite direction R2 in comparison to the direction R1 of the conveying device 4*a*). After passing the last bale opener 2, the conveying section 5*ii*, which runs through 90° to the conveying section 5*i*, is closed. The arrangement of the conveying sections 5*i*, 5*ii* for transferring the fiber mixture M2 from one conveying section 5*i*, 5*ii* to the other (and the additional subsequent transferring) is known to a specialist, and need not be explained in more detail here. At the end of the conveying section 5*ii*, the additional conveying section 5*iii* follows, whereas both conveying sections are likewise offset by 90° relative to each other, and the two conveying sections 5*i*, 5*iii* run in opposite directions. Thus, the conveying device 4*b* ensures a 180° deflection of the fiber mixture M2.

A weighing device or a scale 6 is indicated in the transport path of the two conveying devices 4*a*, 4*b*, which weighing device or scale weighs the fiber mixture M1 or M2 and controls subsequent textile machines (for example, the processing device 10) and/or regulates upstream machines (for example, the bale openers 2 and/or conveying devices 4*a*, 4*b*).

The two fiber mixtures M1, M2, which are ultimately transported parallel in the direction R1, are fed to a collecting device 7, into which the two conveying devices 4*a*, 4*b* open. In the present case, it is indicated that the two fiber mixtures M1, M2 are not fed side by side into the collecting device 7. Rather, an additional conveying section 5*iv* is provided on the last section of the conveying device 4*b*, which conveying section 5*iv* guides the fiber mixture obliquely to the collecting device 7. Other transport methods and directions for combining the fiber mixtures M1, M2 are readily possible.

In the present case, the collecting device 7 is designed as a fiber air separator, in which the fiber mixtures M1, M2 are introduced. By this, the conveying device 4*a* can feed the fiber mixture M1, for example, directly into the collecting device 7 (mechanical feed) while the fiber mixture M2 is pneumatically sucked into the collecting device 7. In the collecting device 7, the fiber mixtures M1, M2 are separated from the air and combined into an overall fiber mixture GM. According to one alternative, a fiber accumulator can be used instead of a fiber air separator.

The collecting device 7 is adjoined by a feeding device 9, into which the overall fiber mixture GM is transported, for example, by means of a belt conveyor 8. From the feed device 9, which is preferably formed as a tray feeder or a filling reservoir, the overall fiber mixture GM is ultimately fed into the processing device 10, for example a mixing chamber or a carding feed or a carding engine. From this, the resulting fiber mixture RM is transported away by means of an additional conveying device 11. The transport of the fiber mixtures from the collecting device 7 is represented by a dashed arrow.

In the following description of the alternative embodiment shown in FIG. 2, the same reference signs are used for characteristics that are identical and/or at least comparable in comparison to the first embodiment shown in FIG. 1, in its arrangement and/or mode of operation. To the extent that they are not explained again in detail, their arrangements and/or modes of action correspond to the arrangements and modes of action of the previously described characteristics.

Figure 2:
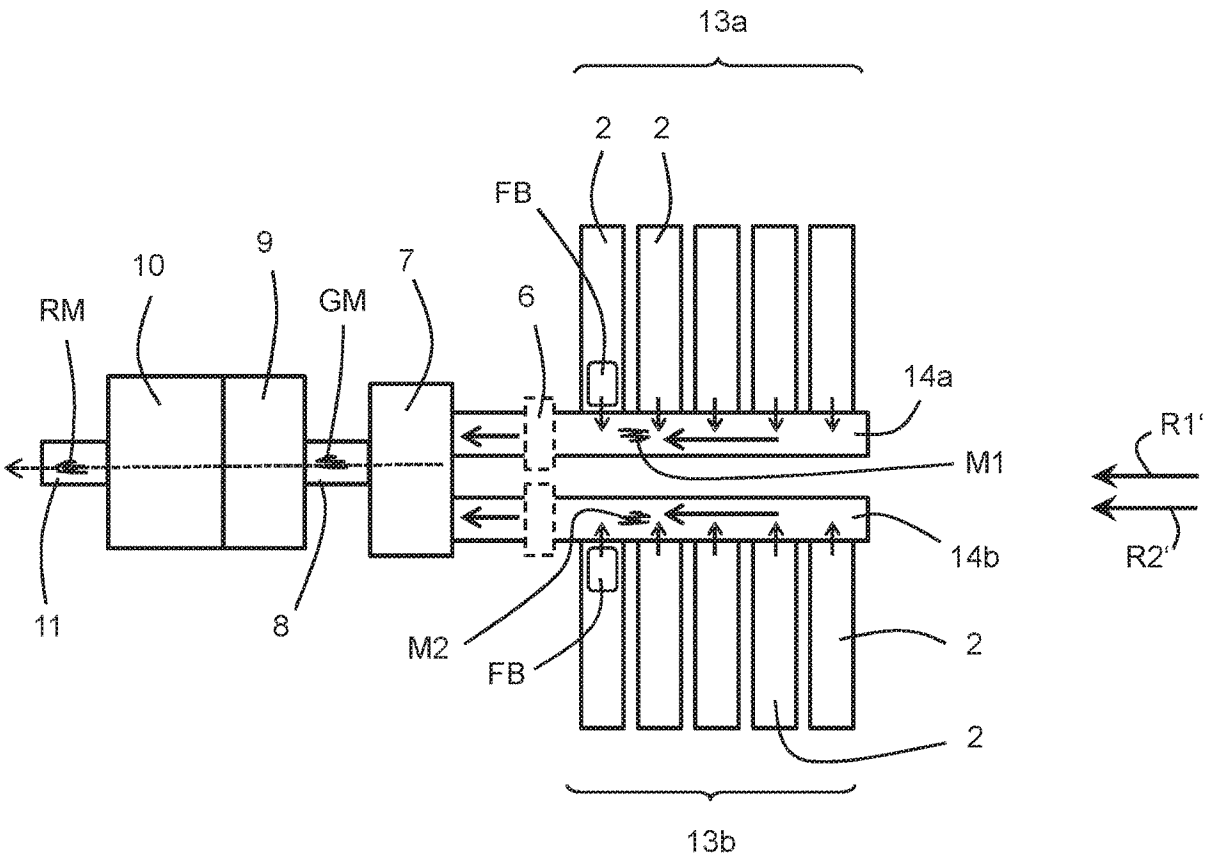

In FIG. 2, the two opener groups 13*a*, 13*b*, with five bale openers 2 each, are schematically shown in a top view. With the upper opener group 13*a* is shown in FIG. 2, its fiber mixture M1 is transported away by means of the conveying device 14*a*—viewed in relation to the outlet of the bale opener 2 of this opener group 13*a*—to the right in the direction R1', while, with the lower opener group 13*b*, its fiber mixture M2 is transported away by means of the conveying device 14*b*—viewed in relation to the outlet of its bale opener 2—to the left in the direction R2'. Thus, in relation to the respective opener groups 13*a*, 13*b*, the two fiber mixtures M1, M2 are conveyed in different directions, and here in the opposite directions. Such directions R1', R2' coincide in absolute terms (that is, not in relative terms with respect to the opener groups 13*a*, 13*b*) and lead to the collecting device 7.

The two conveying devices 14*a*, 14*b* are shown in FIG. 2 as separate conveying devices, for example as separate conveyor belts. However, it is also advantageous for the two conveying devices 14*a*, 14*b* to be formed as a single common conveying device (not shown), for example as a relatively wide conveyor belt, which can be, for example, 2 m wide. On one half of this conveyor belt, the fiber mixture M1 is then deposited from the one side, while the fiber mixture M2 is dispensed off the other side onto the other half of the conveyor belt. The overall conveying width can be reduced by means of mechanical slides, such that this amounts to, for example, 80 cm, and thus can pass through a scale according to the state of the art.

The invention has been explained in more detail based on embodiments. This invention is not limited to the illustrated and described embodiments. Modifications within the scope of the claims are, however, readily possible, as is any combination of the characteristics, even if they are shown and described in different embodiments. For example, three or more opener groups with the same or at least a partially different number of bale openers, with a respectively connected conveying device, are also possible. Moreover, the number of bale openers per opener group is not set to a certain number. The multiple number of opener groups of a fiber processing system can also feature varying numbers of bale openers.

LIST OF REFERENCE SIGNS

1 Fiber processing system
2 Bale opener
3*a* Opener group
3*b* Opener group
4*a* Conveying device
4*b* Conveying device
5*i* Conveying section
5*ii* Conveying section
5*iii* Conveying section

5*iv* Conveying section
6 Scale
7 Collecting device
8 Conveying device
9 Feeding device
10 Processing device
11 Conveying device
13*a* Opener group
13*b* Opener group
14*a* Conveying device
14*b* Conveying device
M1 Fiber mixture
M1 Fiber mixture
GM Overall fiber mixture
RM Resulting mixture
R1 Direction
R2 Direction
R1' Direction
R2" Direction

The invention claimed is:

1. A fiber processing system for opening and mixing fiber material, comprising:

a plurality of bale openers for opening fiber bales;

conveying devices downstream of the bale openers for mixing and conveying the opened fiber material to a downstream processing device, wherein the bale openers are stationary relative to the conveying devices and are configured as weighing tray feeders;

the bale openers divided into at least two opener groups, each opener group producing a respective fiber mixture;

each opener group allocated with one or more of the conveying devices arranged in such a manner that the respective fiber mixtures are transported directly away from their associated opener group in opposite transport directions relative to their opener group prior to the fiber mixtures being subsequently combined before or in the processing device into an overall fiber mixture.

2. The fiber processing system according to claim 1, wherein the bale openers are arranged in one row in each of the opener groups.

3. The fiber processing system according to claim 1, wherein the opener groups are arranged opposite each other, wherein the fiber mixtures that are conveyed in opposite directions relative to their associated opener group are conveyed in a same direction relative to the processing device.

4. The fiber processing system according to claim 3, wherein the conveying devices from each of the opener groups are defined as one common conveying device on which the fiber mixtures are conveyed side by side.

5. The fiber processing system according to claim 1, wherein at least one of the conveying devices comprises one or more fiber conveyor belts.

6. The fiber processing system according to claim 1, wherein at least one of the conveying devices is formed as a conveying tube.

7. The fiber processing system according to claim 1, further comprising a collecting device upstream of the processing device where the fiber mixtures are combined.

8. The fiber processing system according to claim 7, wherein the collecting device comprises a fiber air separator or a fiber accumulator.

9. The fiber processing system according to claim 7, wherein processing device is connected downstream of a feeding device, the feeding device connected downstream of the collecting device.

10. A method for opening and mixing fiber material in a fiber processing system, comprising:

opening fiber bales with a plurality of bale openers;

dividing the bale openers into at least two opener groups, wherein each opener group produces a respective fiber mixture;

depositing each fiber mixture onto a conveying device associated with each of the opener groups, the conveying devices arranged such that the respective fiber mixtures are transported directly away from their associated opener group in opposite transport directions relative to their opener group;

wherein the bale openers are stationary relative to the conveying devices and are configured as weighing tray feeders to weigh fiber material opened by the bale opener; and subsequently combining the fiber mixtures into an overall fiber mixture before or in a downstream processing device.

11. The method according to claim 10, wherein the bale openers are arranged in one row in each of the opener groups, the rows arranged side by side or opposite one another.

12. The method according to claim 10, further comprising mechanically or pneumatically combining the fiber mixtures in a collecting device.

13. The method according to one claim 12, wherein the combined fiber mixture is conveyed to a feeding device, the feeding device in turn feeding the processing device.

* * * * *